US006605900B2

(12) United States Patent
Chien

(10) Patent No.: US 6,605,900 B2
(45) Date of Patent: Aug. 12, 2003

(54) RECHARGEABLE EMERGENCY LAMP TUBE

(76) Inventor: Yung-Lin Chien, No. 33, Yu-Lien Street, Pa-Tier, Taoyuan (TW)

( * ) Notice: Subject to any disclaimer, the term of this patent is extended or adjusted under 35 U.S.C. 154(b) by 94 days.

(21) Appl. No.: 09/978,038

(22) Filed: Oct. 17, 2001

(65) Prior Publication Data

US 2003/0071573 A1 Apr. 17, 2003

(51) Int. Cl.[7] ..... H05B 37/02

(52) U.S. Cl. ..... 315/86; 340/333

(58) Field of Search ..... 315/86, 119, 161, 315/175, 176; 340/333, 515, 516, 636

(56) References Cited

U.S. PATENT DOCUMENTS 4,544,910 A * 10/1985 Hoberman ..... 340/333
4,563,629 A * 1/1986 Keiper ..... 320/48
5,646,486 A * 7/1997 Edwards et al. ..... 315/86

* cited by examiner

*Primary Examiner*—Don Wong
*Assistant Examiner*—Wilson Lee
(74) *Attorney, Agent, or Firm*—Troxell Law Office PLLC

(57) ABSTRACT

A rechargeable emergency lamp tube includes a lamp tube holder, the lamp tube holder having a base adapted to obtain AC power supply from an electric socket and a socket adapted to hold a tube for emitting light, a rechargeable battery and a control circuit board mounted inside the lamp tube holder, the control circuit board driving input AC power supply to charge the rechargeable battery and, converting DC battery power supply into AC power supply for the tube upon power failure.

2 Claims, 4 Drawing Sheets

RECHARGEABLE EMERGENCY LAMP TUBE

BACKGROUND OF THE INVENTION

The present invention relates a lamp tube and, more particularly, to a rechargeable emergency lamp tube, which converts DC battery power supply into AC power supply to turn on the tube upon power failure.

Regular commercially available lamp tubes and bulbs work only when external power supply is available. When power failed, regular lamp tubes and bulbs cannot work.

SUMMARY OF THE INVENTION

The present invention has been accomplished under the circumstances in view. It is one object of the present invention to provide a rechargeable emergency lamp tube, which works with city power supply when city power supply is available and, which automatically converts DC battery power supply from self-provided rechargeable battery into AC power supply when city power supply failed, keeping the tube in function. It is another object of the present invention to provide a rechargeable emergency lamp tube, which can be fastened to a regular electric socket to function as a regular lamp tube. To achieve these and other objects of the present invention, the rechargeable emergency lamp tube comprises a lamp tube holder, the lamp tube holder having a base adapted to obtain AC power supply from an electric socket and a socket adapted to hold a tube for emitting light, a rechargeable battery and a control circuit board mounted inside the lamp tube holder, the control circuit board driving input AC power supply to charge the rechargeable battery and, converting DC battery power supply into AC power supply for the tube upon power failure.

DETAILED DESCRIPTION OF THE PREFERRED EMBODIMENT

Figure 1:
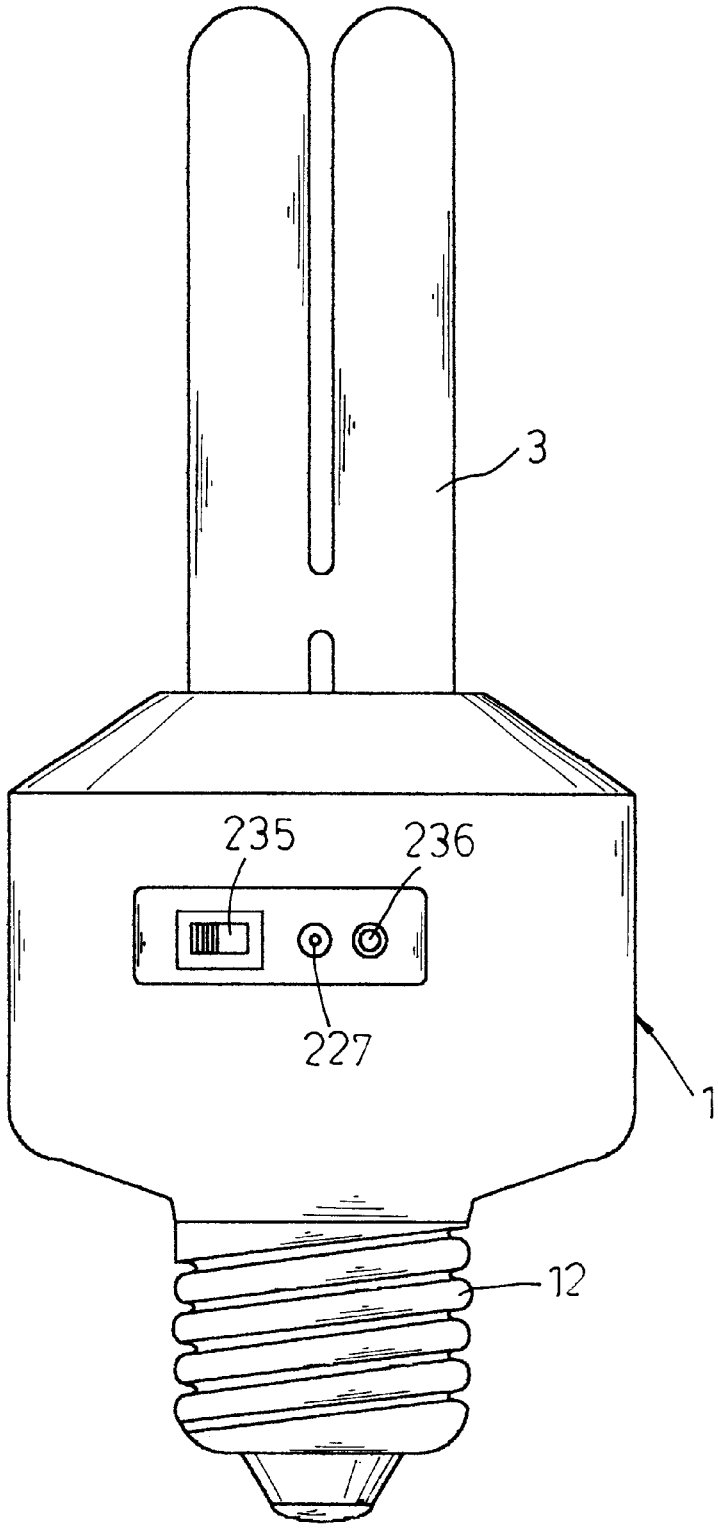
FIG. 1 is an elevational view of a rechargeable emergency lamp tube according to the present invention.
Figure 2:
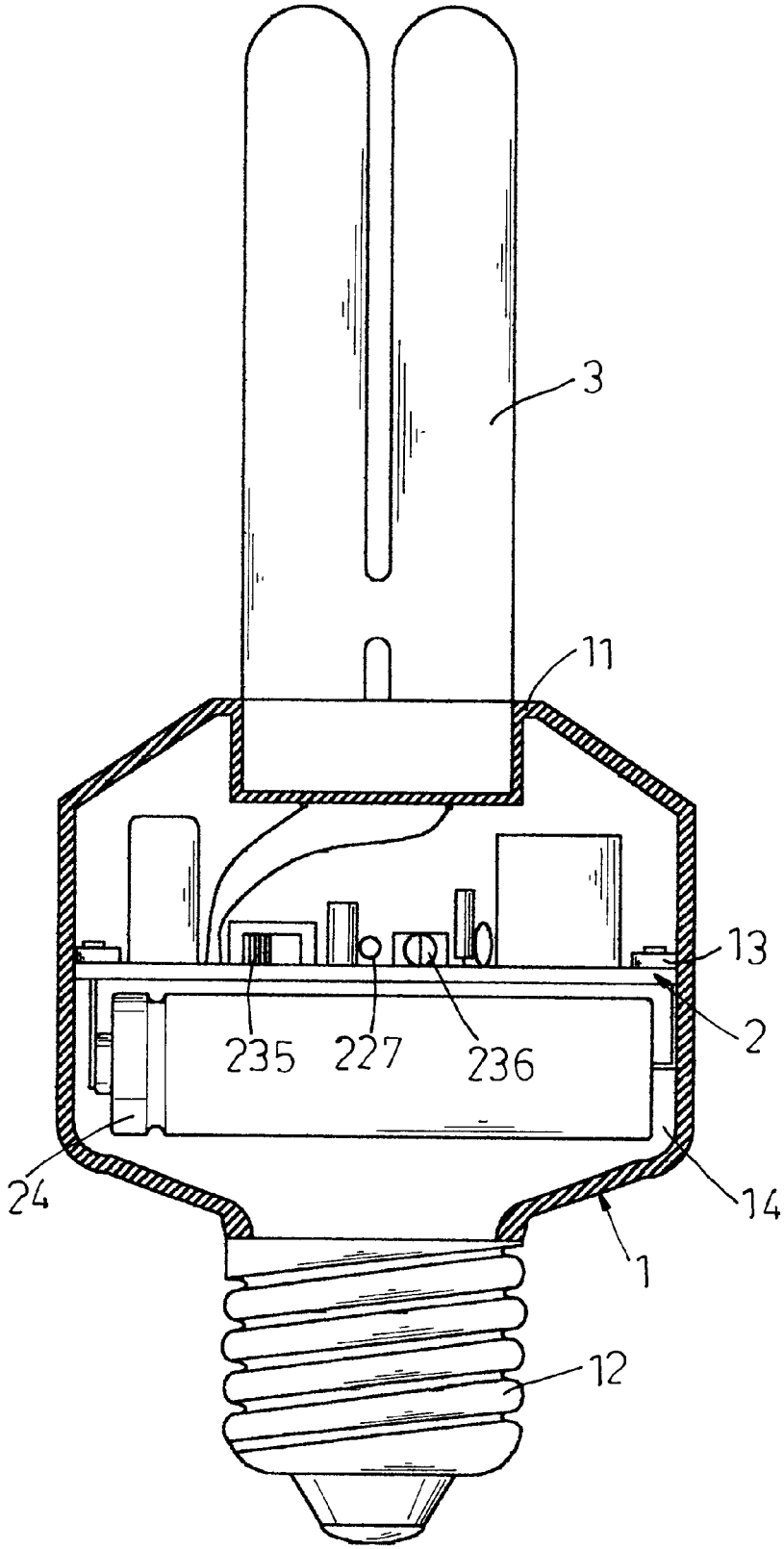
FIG. 2 is a sectional view of the rechargeable emergency lamp tube according to the present invention.

Referring to FIGS. 1 and 2, an emergency lamp tube in accordance with the present invention is shown comprised of a lamp tube holder 1, a control circuit board 2, and a tube 3. The lamp tube holder 1 is a hollow device having a socket 11 at the front side, a base 12 at the rear side, and partition ribs 13 spaced between the socket 11 and the base 12. The socket 11 receives the tube 3. The base 12 is for fastening to a lamp socket. The control circuit board 2 is mounted inside the lamp tube holder 1 and fixedly fastened to the partition ribs 13. After installation of the control circuit board 2 in the lamp tube holder 1, the electric contacts of the socket 11 are respectively connected to respective contacts of the control circuit board 2 by electric wires, and a battery chamber 14 is defined inside the lamp tube holder 1 between the control circuit board 2 and the base 12. A rechargeable battery 24 is installed in the battery chamber 14 and electrically connected to the control circuit board 2.

Figure 3:
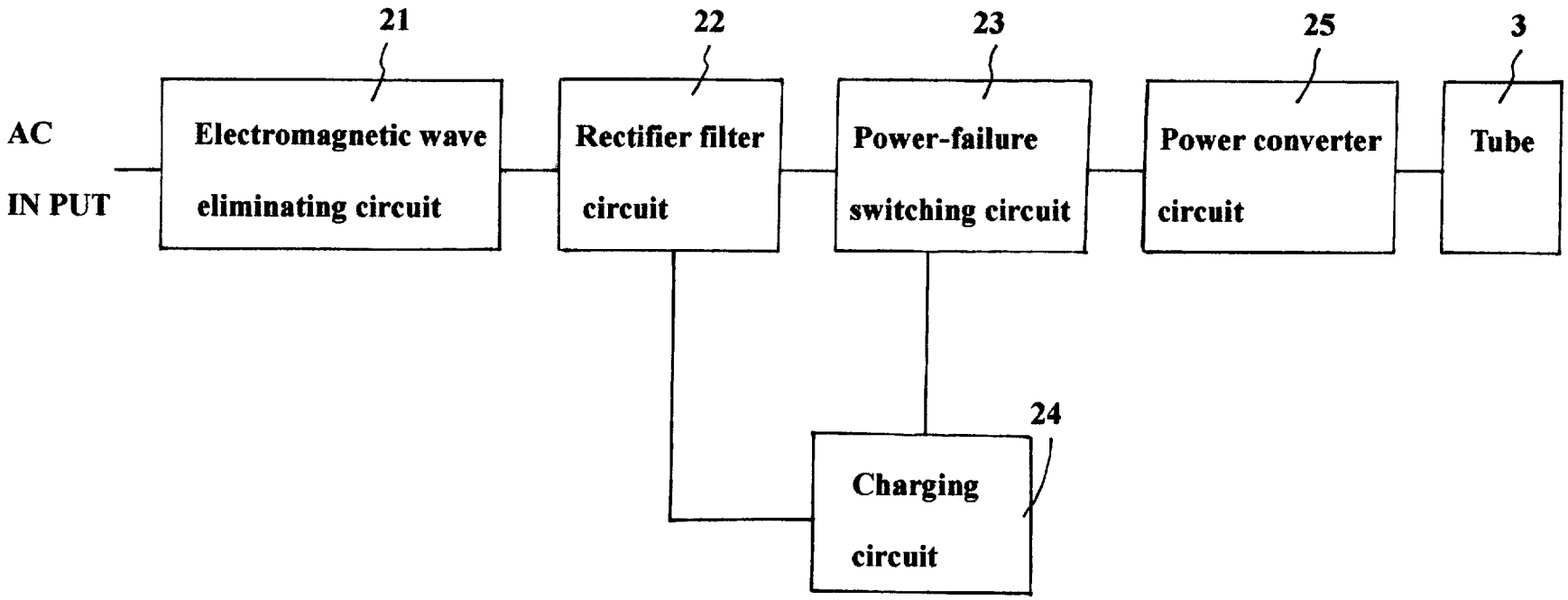
FIG. 3 is a circuit block diagram of the present invention.
Figure 4:
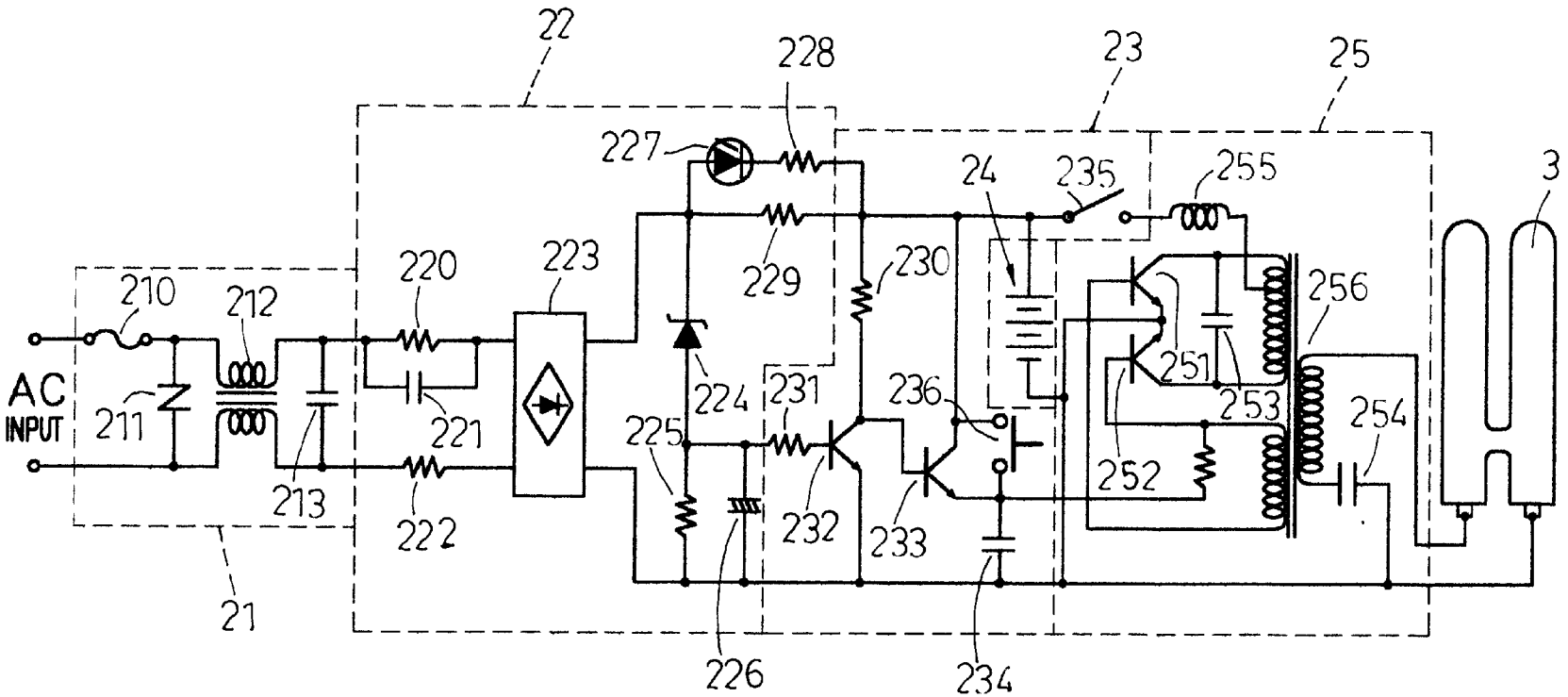
FIG. 4 is a detailed circuit diagram of the present invention.

Referring to FIGS. 3 and 4, the control circuit board 2 comprises an electromagnetic wave eliminating circuit 21, a rectifier filter circuit 22, a power-failure switching circuit 23, a charging circuit 24, and a power converter circuit 25. The electromagnetic wave eliminating circuit 21 is comprised of a fuse 210, a control contact 211, an inductor 212, and a capacitor 213, and adapted to attenuate electromagnetic wave of input AC power supply. The rectifier filter circuit 22 is comprised of four resistors 220, 222, 225, 228, and 229, two capacitors 221 and 226, a bridge rectifier 223, a Zener diode 225, and a LED (light emitting diode) 227, and adapted to convert input AC power supply into DC power supply and to rectify DC power supply into voltage and current of a stable pulse wave for charging the rechargeable battery 24. The LED 227 of the rectifier filter circuit 22 is exposed to the outside of the lamp tube holder 1 for power indication. The power-failure switching circuit 23 is comprised of two resistors 230 and 231, two transistors 232 and 233, two switches 235 and 236, and a capacitor 234. By means of the transistors 232 and 233, the power-failure switching circuit 23 automatically switches on the circuit between the rechargeable battery 24 and the power converter circuit 25 upon power failure. The switches 235 and 236 are respectively exposed to the outside of the lamp tube holder 1. The switch 235 controls battery power supply from the rechargeable battery 24 to the tube 3 through the power converter circuit 25. The switch 236 is a press control test switch adapted to examine the functioning of the tube 3. The rechargeable battery 24 can be a Li-ion battery, or nickel-hydrogen battery. The power converter circuit 25 is comprised of a resistor 250, two transistors 251 and 252, two capacitors 253 and 254, an inductor 255, and a transformer 256, and adapted to convert DC power supply from the rechargeable battery 24 into AC power supply for transmitting to the socket 11 and then the tube 3.

As indicated above, by means of the base 12, the rechargeable emergency lamp tube can be fastened to an electric socket to receive city power supply. When power failed, the power converter circuit 25 directly converts DC power supply from the rechargeable battery 24 into AC power supply to provide the necessary working voltage to turn on the tube 3.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A rechargeable emergency lamp tube comprising:

a lamp tube holder, said lamp tube holder comprising an electric socket disposed at a front side thereof, a base disposed at a rear side thereof for connection to an AC power supply output socket to receive input AC power supply, a plurality of partition ribs spaced between said electric socket and said base, and a battery chamber holding a rechargeable battery;

a tube installed in said electric socket of said lamp tube holder and adapted to emit light upon receipt of AC power supply from said electric socket of said lamp tube; and a control circuit board fixedly fastened to said partition ribs inside said lamp tube holder and electrically connected to said electric socket and said rechargeable battery, said control circuit board comprising an electromagnetic wave eliminating circuit, said electromagnetic wave eliminating circuit comprised of a fuse, a control contact, an inductor, and a capacitor, and adapted to attenuate electromagnetic wave of input AC power supply from said base, a rectifier filter circuit, said rectifier filter circuit comprised of four resistors, two capacitors, a bridge rectifier, and a Zener diode, and adapted to convert input AC power supply into DC power supply and to rectify DC power supply into voltage and current of a stable pulse wave to charge said rechargeable battery, a power-failure switching circuit, said power-failure switching circuit comprised of two resistors, two transistors, and a capacitor and adapted to switch battery power supply from said rechargeable battery a power converter circuit upon power failure of input AC power supply from said base, and a power converter circuit connected between said electric socket and said power-failure switching circuit and comprised of a resistor, two transistors, two capacitors, an inductor, and a transformer, and adapted to convert DC power supply from said rechargeable battery into AC power supply for transmitting to said electric socket and said tube.

2. The rechargeable emergency lamp tube as claimed in claim 1 wherein said rectifier filter circuit further comprises a light emitting diode exposed to the outside of said lamp tube holder for power indication; said power-failure switching circuit further comprises a first switch disposed outside said lamp tube holder and adapted to control battery power supply from said rechargeable battery to said electric tube through said power converter circuit, and a second switch disposed outside said lamp tube holder and adapted to examine the functioning of said tube.

* * * * *